US011735826B2

(12) United States Patent
Shamblin et al.

(10) Patent No.: US 11,735,826 B2
(45) Date of Patent: Aug. 22, 2023

(54) MODAL ANTENNA SYSTEM INCLUDING CLOSED-LOOP PARASITIC ELEMENT

(71) Applicant: Kyocera AVX Components (San Diego), Inc., San Diego, CA (US)

(72) Inventors: John Eric Shamblin, San Diego, CA (US); Jesse Shihchieh Hsin, San Diego, CA (US); Zachary Rocha, San Diego, CA (US); Lynn Chiu, San Diego, CA (US); Mehak Garg, San Diego, CA (US); Zhe Wang, San Diego, CA (US)

(73) Assignee: Kyocera AVX Components (San Diego), Inc., San Diego, CA (US)

( * ) Notice: Subject to any disclaimer, the term of this patent is extended or adjusted under 35 U.S.C. 154(b) by 0 days.

(21) Appl. No.: 17/306,441

(22) Filed: May 3, 2021

(65) Prior Publication Data

US 2021/0376478 A1 Dec. 2, 2021

Related U.S. Application Data

(60) Provisional application No. 63/030,941, filed on May 28, 2020.

(51) Int. Cl.
*H01Q 19/00* (2006.01)
*H01Q 1/48* (2006.01)

(52) U.S. Cl.
CPC ..... *H01Q 19/005* (2013.01); *H01Q 1/48* (2013.01)

(58) Field of Classification Search
CPC ..... H01Q 19/005; H01Q 5/335; H01Q 5/392; H01Q 9/30; H01Q 9/42
See application file for complete search history.

(56) References Cited

U.S. PATENT DOCUMENTS

| | | | | |
|---|---|---|---|---|
| 5,966,097 | A * | 10/1999 | Fukasawa | H01Q 19/005 343/702 |
| 6,339,402 | B1 * | 1/2002 | McKivergan | H01Q 1/243 343/702 |
| 6,456,243 | B1 | 9/2002 | Poilasne et al. | |
| 6,456,249 | B1 * | 9/2002 | Johnson | H01Q 9/0442 343/702 |
| 6,717,551 | B1 * | 4/2004 | Desclos | H01Q 1/241 343/803 |
| 6,744,410 | B2 | 6/2004 | Shamblin et al. | |
| 6,943,730 | B2 | 9/2005 | Poilasne et al. | |
| 7,663,556 | B2 | 2/2010 | Desclos et al. | |
| 7,696,932 | B2 | 4/2010 | Desclos et al. | |
| 9,634,404 | B1 * | 4/2017 | Rowson | H01Q 5/385 |
| 10,109,909 | B1 * | 10/2018 | Rowson | H01Q 9/42 |

(Continued)

FOREIGN PATENT DOCUMENTS

WO WO2003092118 11/2003

*Primary Examiner* — Jason Crawford
(74) *Attorney, Agent, or Firm* — Dority & Manning, P.A.

(57) ABSTRACT

An antenna system can include a ground plane and a driven element spaced apart from the ground plane. The antenna system can include a parasitic element disposed proximate to the driven element. The parasitic element can be coupled to the ground plane by a first coupling and a second coupling. The second coupling can be independent from the first coupling. For instance, the first coupling can include one or more tunable components. The second coupling can fix the parasitic element to the ground plane.

17 Claims, 7 Drawing Sheets

(56) References Cited

U.S. PATENT DOCUMENTS

| | | | | |
|---|---|---|---|---|
| 2002/0070902 | A1* | 6/2002 | Johnson | H01Q 19/005 343/702 |
| 2020/0303840 | A1* | 9/2020 | Singh | H01Q 25/04 |
| 2021/0167500 | A1* | 6/2021 | Declos | H01Q 5/378 |
| 2021/0175640 | A1* | 6/2021 | Desclos | H01Q 21/20 |
| 2021/0242586 | A1* | 8/2021 | Singh | H01Q 5/385 |
| 2021/0376478 | A1* | 12/2021 | Shamblin | H01Q 9/42 |
| 2022/0247072 | A1* | 8/2022 | Shamblin | H01Q 3/2611 |

* cited by examiner

MODAL ANTENNA SYSTEM INCLUDING CLOSED-LOOP PARASITIC ELEMENT

PRIORITY CLAIM

The present application claims the benefit of priority of U.S. Provisional App. No. 63/030,941, titled "Modal Antenna System Including Closed-Loop Parasitic Element," having a filing date of May 28, 2020, which is incorporated by reference herein.

FIELD

Example aspects of the present disclosure relate generally to the field of antenna systems, such as, for instance, modal antenna systems configured to operate in a plurality of different modes.

BACKGROUND

Modal antennas are being increasingly used in wireless communication, for instance in smartphone handsets. Such antennas generally provide improved signal quality and a more compact form factor than traditional passive antennas. One modal antenna configuration involves a parasitic element configured to alter a radiation pattern associated with a driven element.

SUMMARY

Aspects and advantages of embodiments of the present disclosure will be set forth in part in the following description, or can be learned from the description, or can be learned through practice of the embodiments.

One example aspect of the present disclosure is directed to an antenna system. The antenna system can include a ground plane and a driven element spaced apart from the ground plane. The antenna system can include a parasitic element disposed proximate to the driven element. The parasitic element can be coupled to the ground plane by a first coupling and a second coupling. The second coupling can be independent from the first coupling. For instance, the first coupling can include one or more tunable components. The second coupling can fix the parasitic element to the ground plane.

Another example aspect of the present disclosure is directed an antenna system. The antenna system includes a ground plane. The antenna system further includes a planar driven element. The planar drive element is spaced apart from the ground plane and coupled to a first one or more tunable components. The antenna system includes a parasitic element disposed proximate to the planar driven element. The parasitic element includes a substantially horizontal portion. The parasitic element further includes a first substantially vertical portion and a second substantially vertical portion. The first substantially vertical portion is coupled to the ground plane by a first coupling comprising a first coupling tunable component. The second substantially vertical portion is coupled to the ground plane by a second coupling that is independent from the first coupling.

These and other features, aspects and advantages of various embodiments will become better understood with reference to the following description and appended claims. The accompanying drawings, which are incorporated in and constitute a part of this specification, illustrate embodiments of the present disclosure and, together with the description, serve to explain the related principles.

BRIEF DESCRIPTION OF THE DRAWINGS

Detailed discussion of embodiments directed to one of ordinary skill in the art are set forth in the specification, which makes reference to the appended figures, in which.

DETAILED DESCRIPTION

Figure 1A:
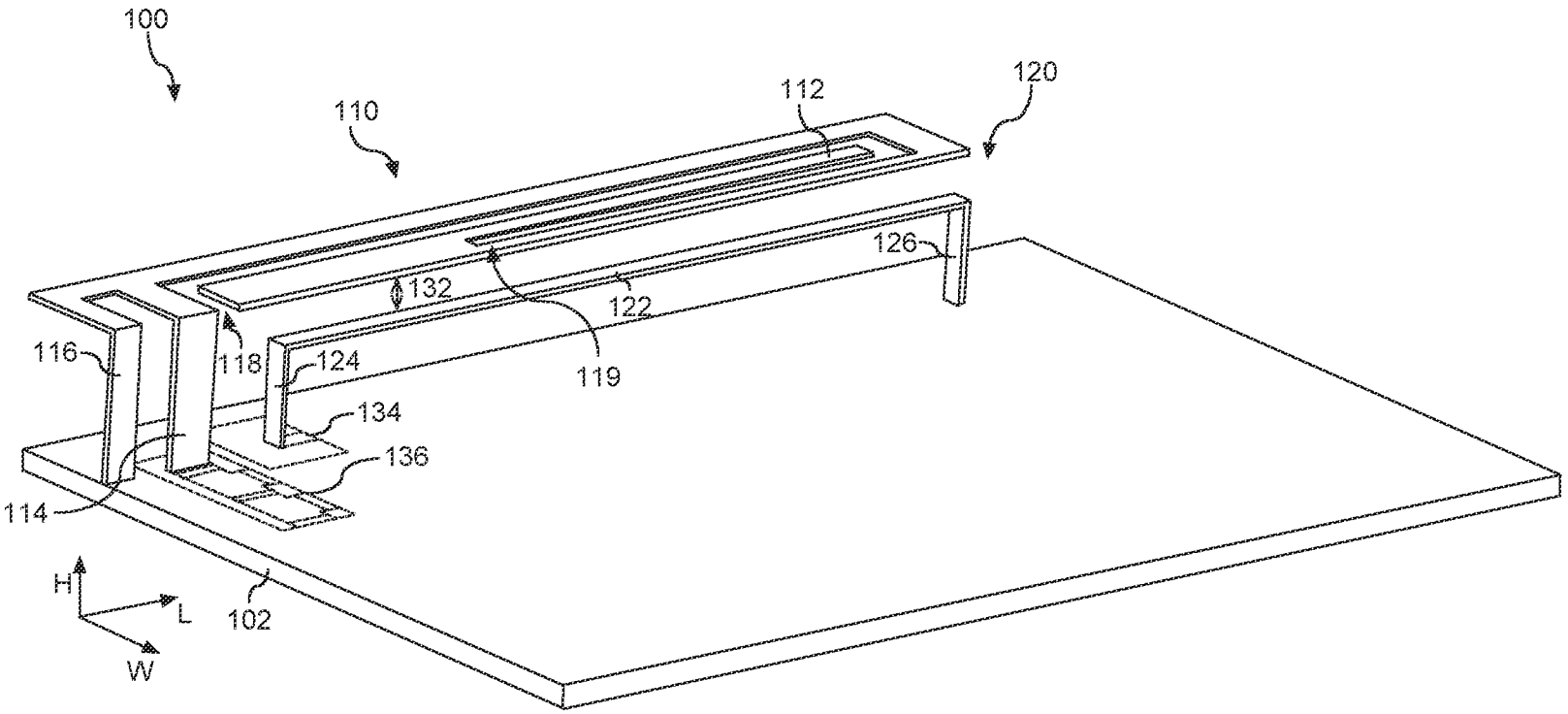
FIG. 1A illustrates an isometric view of an antenna system including a closed-loop parasitic element according to example embodiments of the present disclosure.

Reference now will be made in detail to embodiments, one or more examples of which are illustrated in the drawings. Each example is provided by way of explanation of the embodiments, not limitation of the present disclosure. In fact, it will be apparent to those skilled in the art that various modifications and variations can be made to the embodiments without departing from the scope or spirit of the present disclosure. For instance, features illustrated or described as part of one embodiment can be used with another embodiment to yield a still further embodiment. Thus, it is intended that aspects of the present disclosure cover such modifications and variations.

Example aspects of the present disclosure are directed to an antenna system. The antenna system can include a modal antenna including a driven element and a parasitic element disposed proximate to the driven element. The driven element and parasitic element can be coupled to a ground plane and/or spaced apart from a ground plane. The modal antenna can be operable in a plurality of different modes, and each mode can be associated with a different radiation pattern and/or polarization state. The antenna system can include a tuning circuit that is configured to control an electrical characteristic associated with the parasitic element to operate the modal antenna in the plurality of different modes.

According to example embodiments of the present disclosure, the parasitic element can be coupled to a ground plane by a first coupling and a second coupling. The second coupling can be independent from the first coupling. For instance, the second coupling can be spaced apart from the first coupling and can provide a separate path to ground relative to the first coupling. The first coupling can include one or more tunable components. For instance, the tunable components can include a switch, tunable capacitor, MEMS device, tunable inductor, a tunable phase shifter, a field-effect transistor, or a diode, or combination thereof.

In some embodiments, the driven element can be or can include a planar driven element. For example, a length and/or width of the driven element can be significantly greater than a height of the driven element such that the driven element forms a plane. In some implementations, The planar driven element can be parallel to the ground plane.

In some embodiments, the driven element can be a spiral planar driven element. For instance, a spiral planar driven element can include a continuous airgap between a periphery of the driven element and a center airgap portion. The center portion can, for instance, be surrounded by the driven element on at least three sides. In some embodiments, the airgap can enclose an isolated portion of the driven element that produces a magnetic dipole. For instance, in some embodiments, the driven element can be an isolated magnetic dipole driven element forming an isolated magnetic dipole antenna system.

In some embodiments, the driven element can be coupled to at least one active component. For example, the at least one active component can be or can include an impedance matching circuit. The impedance matching circuit can include components configured to impedance match the driven element. For instance, a first driven element coupling can couple the driven element to the at least one active component. In some embodiments, the driven element can be coupled to the ground plane by a second driven element coupling that is independent from the first driven element coupling.

In some embodiments, the parasitic element can include a substantially horizontal portion, a first substantially vertical portion, and a second substantially vertical portion. As one example, the vertical portions can be or include planar vertical portions that perpendicularly intersect a planar surface of the ground plane. In some cases, the vertical portions can be aligned and/or parallel. The substantially horizontal portion can perpendicularly intersect the vertical portions. The substantially vertical portions can be and/or can form at least a portion of couplings (e.g., a first coupling and a second coupling) between the substantially horizontal portion and ground. For example, the first substantially vertical portion can form at least a portion of the first coupling and the second substantially vertical portion can form at least a portion of the second coupling.

The substantially horizontal portion can be parallel to the ground plane and/or the driven element. For instance, in some embodiments, the driven element can define a longest driven element dimension and the substantially horizontal portion can define a longest horizontal portion dimension. The longest driven element dimension and longest horizontal portion dimension can be substantially parallel (e.g., within about 10 degrees of parallel). As another example, the substantially horizontal portion can be planar and/or parallel to the ground plane. For instance, a plane defined by the length and width of the substantially horizontal portion can be parallel to the ground plane.

In some embodiments, the substantially horizontal portion can be vertically offset and/or horizontally offset from the driven element. For example, a spacing between the substantially horizontal portion and the ground plane can be less than a spacing between the driven element and the ground plane such that a vertical spacing (e.g., with respect to the height) is defined between the substantially horizontal portion and the driven element. As another example, the substantially horizontal portion can be disposed such that a horizontal spacing (e.g., with respect to the length and/or width) is defined between the driven element and the substantially horizontal portion.

The parasitic element can be a closed-loop parasitic element. For example, the substantially vertical portions, substantially horizontal portion, and ground plane can define a parasitic loop that is configured to interact with the driven element to alter a radiation pattern of the antenna system. As one example, the substantially vertical portions can be disposed on opposite ends of the substantially horizontal portion to form the parasitic loop.

The parasitic loop can be adjusted by a tunable component (e.g., a switch configured to open and/or close the loop) to adjust a radiation pattern of the antenna system (e.g., as part of a beam steering and/or beam forming process). For instance, in some embodiments, the first coupling can include at least one tunable component. A tuning circuit can control the at least one tunable component to adjust an electrical characteristic of the parasitic element. For instance, adjusting the electrical characteristic can additionally adjust a radiation pattern of the antenna system. In some embodiments, the at least one tunable component of the first coupling can include at least one of a switch, tunable capacitor, MEMS device, tunable inductor, a tunable phase shifter, a field-effect transistor, or a diode, or combination thereof.

Additionally, the second coupling can fix the parasitic element to the ground plane such that the second coupling cannot be disconnected. For instance, in some embodiments, the second coupling (e.g., the second substantially vertical portion can be welded, soldered, or otherwise attached to the ground plane. As another example, the second coupling can be formed contiguously with the ground plane (e.g., formed of a same metal sheet).

In some embodiments, the parasitic element can be monolithic. For instance, each of the substantially vertical portions and/or the substantially horizontal portion can be contiguous, formed of a same sheet, etc., such that the parasitic element is a single piece (e.g., does not include any airgaps that interrupt an electron flow from the first coupling to the second coupling).

In some embodiments, the at least one tunable component coupled to the parasitic element and the at least one active component coupled to the driven element can be disposed on a common substrate. For instance, the first coupling of the parasitic element and the active component can be disposed near a same end of the driven element such that the active component(s) and tunable component(s) can be included on the same substrate (e.g., same circuit board). This can allow for antenna circuitry for tuning and/or impedance matching to be commonly manufactured in a single circuit, which can be beneficial in improving ease of manufacture and/or decreasing cost.

Aspects of the present disclosure can achieve a number of technical effects and benefits. As one example, the closed-loop parasitic element as described herein can provide for improved control of antenna systems. For example, the closed-loop parasitic element as described herein can allow for antenna systems that provide an increased tuning range. For instance, peak efficiency can be better preserved across a wider band of frequencies.

Figure 1B:
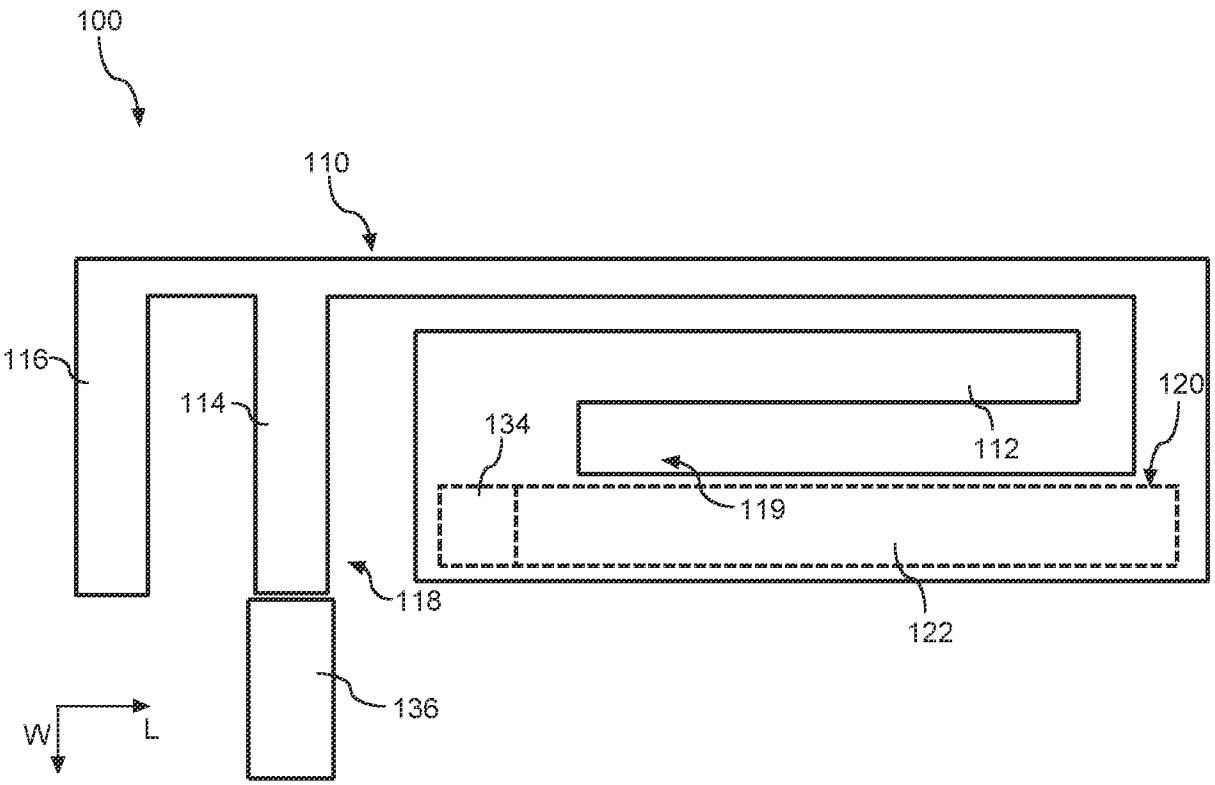
FIG. 1B illustrates a top view of an antenna system including a closed-loop parasitic element according to example embodiments of the present disclosure.

FIG. 1A illustrates an isometric view of an antenna system 100 including a closed-loop parasitic element according to example embodiments of the present disclosure. Additionally, FIG. 1B illustrates a top view of an antenna system 100 including a closed-loop parasitic element according to example embodiments of the present disclosure. The antenna system 100 can include ground plane 102. Ground plane 102 can be electrically grounded (e.g., to earth ground, a ground terminal of a power supply, etc.). Ground plane 102 can be formed of any suitable material, such as, for example, a conductive material. In some embodiments, ground plane 102 can be formed on a substrate, such as a circuit board.

The antenna system 100 can further include driven element 110. Driven element 110 can be spaced apart from the ground plane 102 (e.g., in a height direction H). For instance, a vertical spacing can be defined between driven element 110 and ground plane 102. A length and/or width (e.g., along the length direction L and width direction W) of the driven element 110 can be significantly greater than a height of the driven element 110 (e.g., along the height direction H) such that the driven element 110 forms a plane that is parallel to the ground plane 102.

Driven element 110 can include a continuous airgap 118 between a periphery of the driven element 110 and a center airgap portion 119. The center airgap portion 119 can, for instance, be surrounded by the driven element 110 on at least three sides. In some embodiments, the continuous airgap 118 can enclose an isolated portion 112 of the driven element that produces a magnetic dipole.

Driven element 110 can be coupled to at least one active component 136. For example, the at least one active component 136 can be or include an impedance matching circuit. The impedance matching circuit can include components configured to impedance match the driven element 110. For instance, a first driven element coupling 114 can couple the driven element 110 to the at least one active component 136. Driven element 110 can be coupled to the ground plane 102 by a second driven element coupling 116 that is independent from the first driven element coupling. For instance the first driven element coupling 114 and/or second driven element coupling 116 can be or can include planar portions that are disposed perpendicular to the driven element 110 and/or the ground plane 102.

Antenna system 100 can include parasitic element 120. Parasitic element 120 can include a substantially horizontal portion 122, a first substantially vertical portion 124, and a second substantially vertical portion 126. As one example, the vertical portions 124, 126 can be or include planar vertical portions that perpendicularly intersect a planar surface of the ground plane 102. In some embodiments, the vertical portions 124, 126 can be aligned and/or parallel. The substantially horizontal portion 122 can perpendicularly intersect the vertical portions 124, 126. In some embodiments, the vertical portions 124, 126 can be disposed on opposite ends of the substantially horizontal portion 122.

The substantially horizontal portion 122 can be parallel to the ground plane 102 and/or the driven element 110. For instance, in some embodiments, the driven element 110 can define a longest driven element dimension (e.g., along the length direction L) and the substantially horizontal portion can define a longest horizontal portion dimension (e.g., along the length direction L). The longest driven element dimension and longest horizontal portion dimension can be substantially parallel (e.g., within about 10 degrees of parallel). As another example, the substantially horizontal portion 122 can be planar and/or parallel to the ground plane 102. For instance, a plane defined by the length and width of the substantially horizontal portion 122 can be parallel to the ground plane 102.

In some embodiments, the parasitic element 120 can be disposed within an antenna volume defined by driven element 110 and ground plane 102. For instance, substantially horizontal portion 122 can be vertically offset and/or horizontally offset from the driven element 110. For example, a spacing between the substantially horizontal portion and the ground plane can be less than a spacing between the driven element and the ground plane such that a vertical spacing 132 (e.g., with respect to the height dimension H) is defined between the substantially horizontal portion 122 and the driven element 110. As another example, the substantially horizontal portion 122 can be disposed such that a surface of the substantially horizontal portion 122 is contained within a volume defined by edges of the driven element 110 and perpendicular to the ground plane 102.

The substantially vertical portions 124, 126, substantially horizontal portion 122, and ground plane 102 can collectively define a parasitic loop that is configured to interact with the driven element 110 to alter a radiation pattern of the antenna system 100. For instance, the parasitic loop can be adjusted by a tunable component 134 (e.g., a switch configured to open and/or close the loop) to adjust a radiation pattern of the antenna system 100 (e.g., as part of a beam steering and/or beam forming process). For instance, in some embodiments, a first coupling at the first substantially vertical portion 124 can include at least one tunable component 134. A tuning circuit (e.g., of FIGS. 2-4) can control the at least one tunable component 134 to adjust an electrical characteristic of the parasitic element. For instance, adjusting the electrical characteristic can additionally adjust a radiation pattern of the antenna system 100. In some embodiments, the at least one tunable component 134 can include at least one of a switch, tunable capacitor, MEMS device, tunable inductor, a tunable phase shifter, a field-effect transistor, or a diode, or combination thereof. Additionally, a second coupling at second substantially vertical portion 126 can be fixed to the ground plane 102 such that the second coupling cannot be disconnected.

In some embodiments, the at least one tunable component 134 coupled to the parasitic element 120 and the at least one active component 136 coupled to the driven element 110 can be disposed on a common substrate. For instance, the first coupling (e.g., first substantially vertical portion 124) of the parasitic element and the active component 136 can be disposed near a same end of the driven element 110 such that the active component(s) 136 and tunable component(s) 134 can be included on the same substrate (e.g., same circuit board). This can allow for antenna circuitry for tuning and/or impedance matching to be commonly manufactured in a single circuit, which can be beneficial in improving ease of manufacture and/or decreasing cost.

FIGS. 1A-1B depict one example modal antenna system having a plurality of modes for purposes of illustration and discussion. Those of ordinary skill in the art, using the disclosures provided herein, will understand that other modal antennas and/or antenna configurations can be used without deviating from the scope of the present disclosure. As used herein a "modal antenna" refers to an antenna capable of operating in a plurality of modes where each mode is associated with a distinct radiation pattern.

The described configuration can provide an ability to shift the radiation pattern characteristics of the driven element 110 by varying a reactance thereon. Shifting the antenna radiation pattern can be referred to as "beam steering". In instances where the antenna radiation pattern comprises a null, a similar operation can be referred to as "null steering" since the null can be shifted to an alternative position about the antenna system 100 (e.g., to reduce interference). In some embodiments, the first coupling (e.g., first substantially vertical portion 124) can include a switch for connecting the parasitic element 120 to ground when "On" and for terminating the short when "Off". It should, however, be noted that a variable reactance on the parasitic element(s) 120, such as by using a variable capacitor or other tunable component, can further provide a variable shifting of the antenna pattern or the frequency response. For example, the tunable components 134 can include at least one of a tunable capacitor, MEMS device, tunable inductor, switch, a tunable phase shifter, a field-effect transistor, or a diode.

Figure 2:
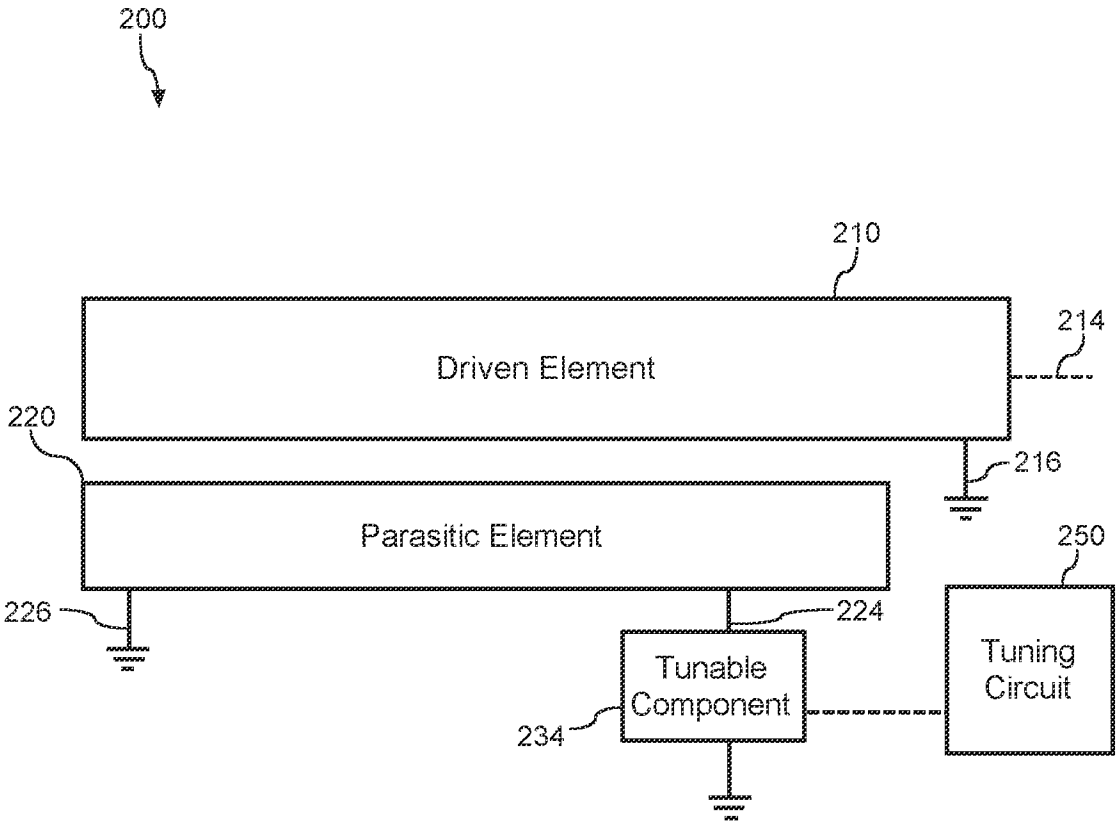
FIG. 2 illustrates a block diagram of at least a portion of an antenna system according to example embodiments of the present disclosure.

FIG. 2 illustrates a block diagram of at least a portion of an antenna system 200 according to example embodiments of the present disclosure. Antenna system 200 can include driven element 210. Driven element 210 can be, for instance, a driven element such as driven element 110 as described above with reference to FIGS. 1A-1B. Any other suitable driven element can be employed in accordance with the present disclosure.

Driven element 210 can communicate RF signals by first driven element coupling 214. For instance, signals on first driven element coupling 214 can be associated with electromagnetic waves at driven element 210. Driven element 210 can be coupled to ground (e.g., a ground plane, such as ground plane 102) by a second driven element coupling 216.

Antenna system 200 can include parasitic element 220. Parasitic element 220 can be, for instance, a closed-loop parasitic element such as parasitic element 120 described above with references to FIGS. 1A-1B. For instance, parasitic element 220 can be configured to adjust a radiation pattern associated with the antenna system 200 based on a tuning of tunable component 234 coupled to the parasitic element 220 by first coupling 224 (e.g., first coupling tunable component 234). As one example, tuning circuit 250 can be configured to adjust an electrical characteristic (e.g., reactance) at tunable component 234. As another example, tuning circuit 250 can be configured to open or close a switch at tunable component 234 (e.g., to selectively short and/or open the first coupling 224). For example, the first coupling 224 and/or tunable component 234 can be configured to selectively ground the parasitic element 220. Additionally, the second coupling 226 can be configured to fix the parasitic element 220 to ground. For instance, the parasitic element 220 can be coupled (e.g., fixed) to ground (e.g., a ground plane, such as ground plane 102) by second coupling 226 to form a closed-loop parasitic element.

Figure 3:
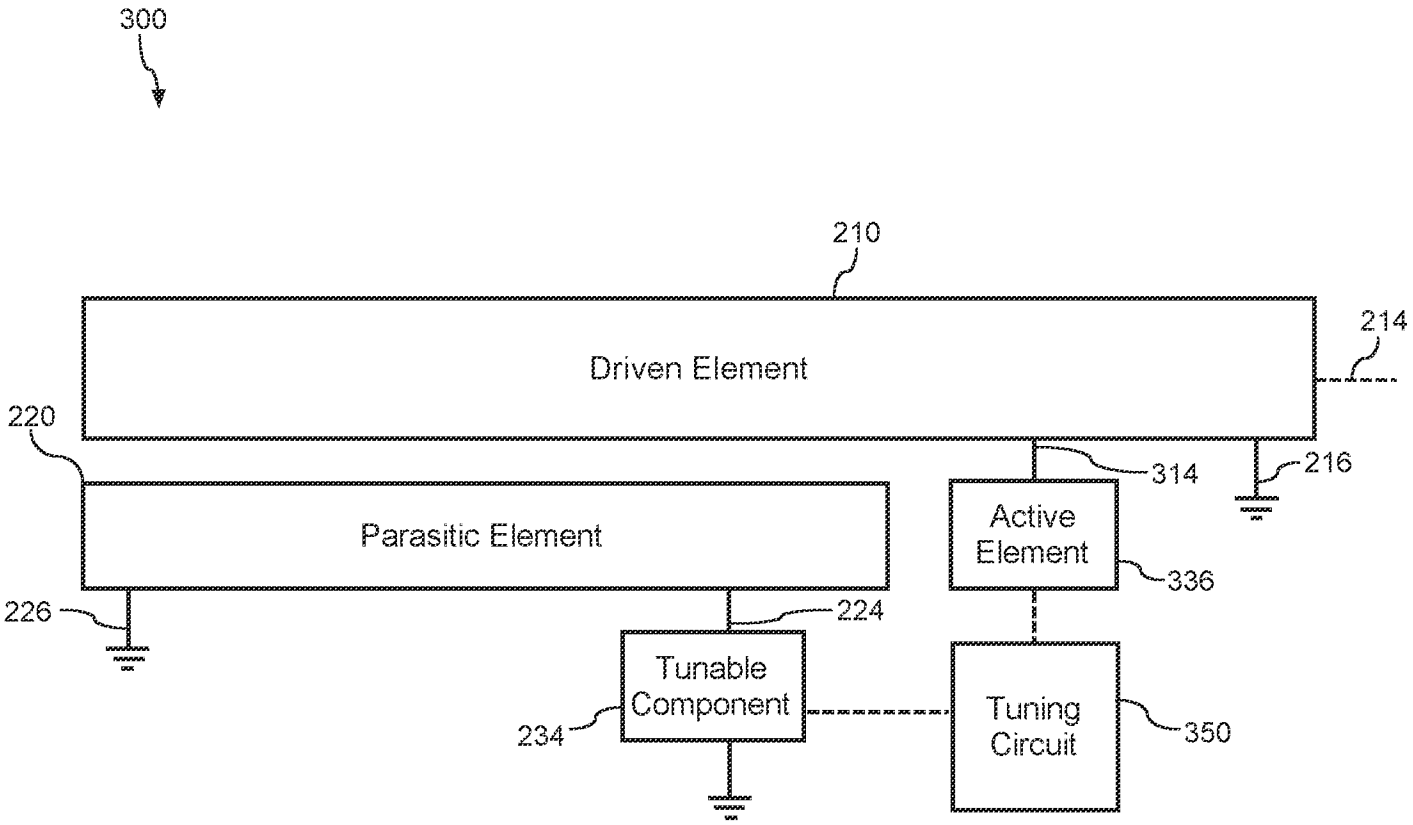
FIG. 3 illustrates a block diagram of at least a portion of an antenna system according to example embodiments of the present disclosure.

FIG. 3 illustrates a block diagram of at least a portion of an antenna system 300 according to example embodiments of the present disclosure. The antenna system 300 can include components similar to antenna system 200 of FIG. 2 (e.g., parasitic element 220). The antenna system 300 can further include one or more active elements 336 coupled to driven element 210 by first coupling 314. Additionally, tuning circuit 350 can be configured to control the active elements 336 (e.g., for impedance matching and/or other functions associated with driven element 210. In some embodiments, the tuning circuit 350, one or more active elements 336, and/or tunable component(s) 334 can be disposed and/or manufactured on a common substrate.

Figure 4:
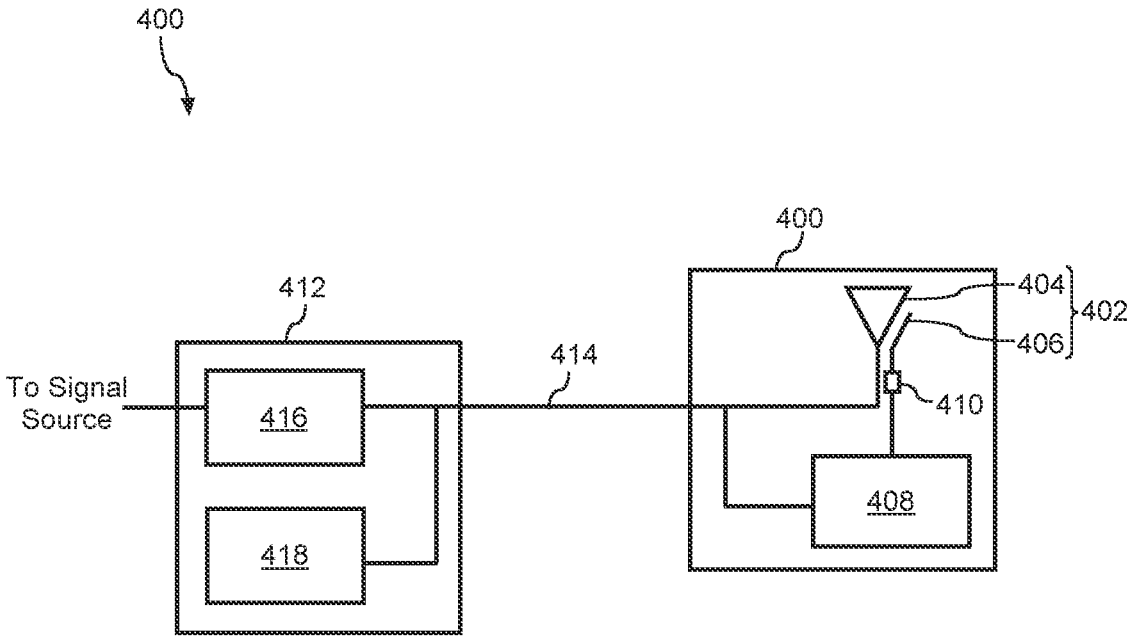
FIG. 4 illustrates a block diagram of at least a portion of an antenna system according to example embodiments of the present disclosure.

FIG. 4 illustrates a schematic diagram of an embodiment of an antenna system 400 in accordance with example aspects of the present disclosure. The antenna system 400 can include a modal antenna 402. The modal antenna 402 can include a driven element 404 and a parasitic element 406 positioned proximate to the driven element 404. The modal antenna 402 can be operable in a plurality of different modes, and each mode can be associated with a different radiation pattern and/or polarization characteristic, for example as described with reference to FIGS. 1A through 3 and FIGS. 5-6.

A tuning circuit 408 (e.g., a tuning circuit) can be configured to control an electrical characteristic associated with the parasitic element 406 to operate the modal antenna 402 in the plurality of different modes. For instance, the tuning circuit 408 can be configured to receive (e.g., demodulate from a transmit signal) a control signal and control the electrical characteristic of the parasitic element 406 based on control instructions associated with the control signal. For example, the control instructions can specify a tuning, switch state, etc. associated with tunable component 410. For instance, tunable component 410 can be coupled with the parasitic element 406 (e.g., to a first coupling of parasitic element 406). The tuning circuit 408 can be configured to control the tunable component 410 to alter the electrical connectivity of a first coupling of parasitic element 406 with a voltage or current source or sink, such as shorting the parasitic element 406 to ground by the first coupling of parasitic element 406 and/or disconnecting the first coupling from ground, and/or adjusting a reactance therebetween.

A radio frequency circuit 412 can be configured to transmit an RF signal to the driven element 404 of the modal antenna 402. For example, one or more transmission lines 414 (e.g., a single coaxial cable) can couple the radio frequency circuit 412 to the modal antenna 402. The radio frequency circuit 412 can be configured to amplify or otherwise generate the RF signal, which is transmitted through the transmission line 414 (e.g., as a component of a transmit signal) to the driven element 404 of the modal antenna 402.

In some embodiments, the radio frequency circuit 412 can include a front end module 416 and/or a control circuit 418. The front end module 416 can be configured to generate and/or amplify the RF signal that is transmitted to and/or received from the driven element 404. The front end module 416 can include, for instance, one or more power amplifiers, low noise amplifiers, impedance matching circuits, etc. The control circuit 418 can be configured to generate and/or transmit a control signal. For example, in some embodiments, the control circuit 418 can modulate the control signal onto the RF signal to produce a transmit signal for transmission by transmission line 414.

In some embodiments, the RF signal can be defined within a first frequency band, and the control signal can be defined within a second frequency band that is distinct from the first frequency band. For example, the first frequency band can range from about 500 MHz to about 50 GHz, in some embodiments from about 1 GHz to about 25 GHz, in some embodiments from about 2 GHz to about 7 GHz, e.g., about 5 GHz. The second frequency band can range from about 10 MHz to about 1 GHz, in some embodiments from about 20 MHz to about 800 MHz, in some embodiments from about 30 MHz to about 500 MHz, in some embodiments from about 50 MHz to about 250 MHz, e.g., about 100 MHz.

Figure 5A:
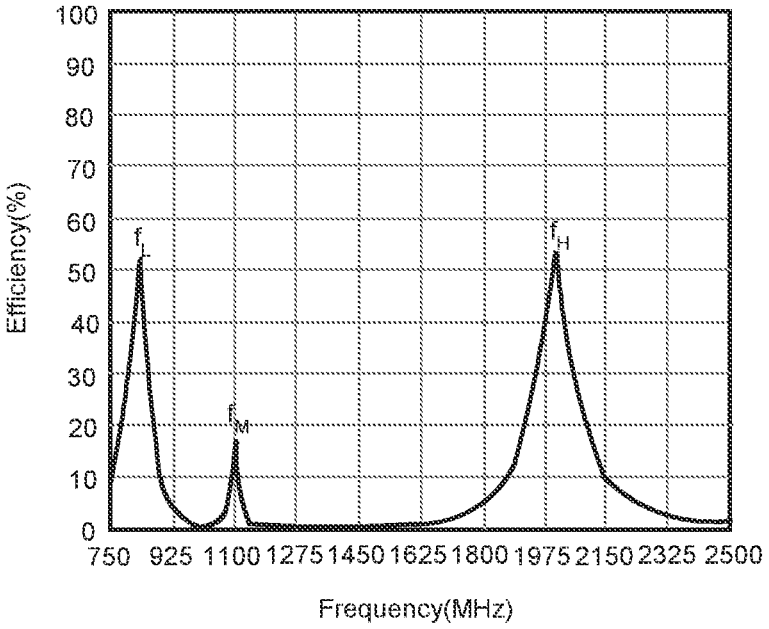
FIG. 5A illustrates a frequency plot of an antenna system including an open-circuited closed-loop parasitic element according to example embodiments of the present disclosure.
Figure 5B:
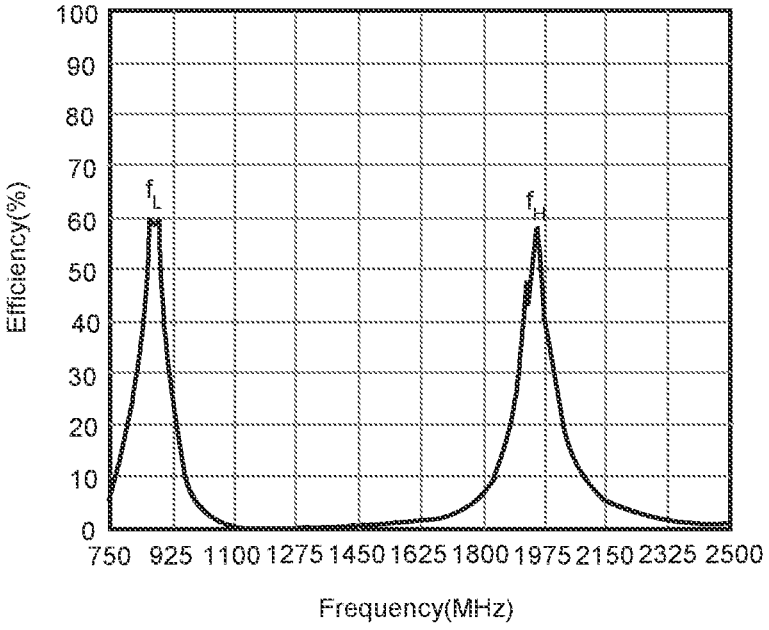
FIG. 5B illustrates a frequency plot of an antenna system including a short-circuited closed-loop parasitic element according to example embodiments of the present disclosure.

FIGS. 5A and 5B illustrate an example frequency plot of the antenna system of any of FIGS. 1A-4 according to some aspects of the present disclosure. For instance, FIG. 5A depicts a frequency plot for an antenna system including a closed-loop parasitic element having a first coupling that is open-circuited (e.g., is disconnected from the ground plane) and a second coupling that fixes the parasitic element to a ground plane. Additionally, FIG. 5B depicts a frequency plot for the antenna system of FIG. 5A where the first coupling is short-circuited to the ground plane in addition to the second coupling fixing the parasitic element to the ground plane. As one example, the first coupling can be a switch that can toggle between the open- and short-circuited states. More generally, the frequency of the antenna can be shifted by controlling an electrical characteristic associated with the closed-loop parasitic element. As one example, a characteristic (e.g., reactance) of a tunable component at the first coupling (e.g., a first coupling tunable component) can be varied to control the electrical characteristic associated with the closed-loop parasitic element.

For example, the antenna system can be configured with the frequency response shown in FIG. 5A or 5B, and/or some frequency responses that lie between (e.g., if the tunable component includes a variable reactance element, such as a varactor diode). As one example, as depicted in FIGS. 5A and 5B, shorting the first coupling of the closed-loop parasitic element can generally "pinch" the upper frequency $f_H$ and lower frequency $f_L$ together. Additionally, shorting the first coupling can reduce a magnitude of a middle frequency $f_M$. Whereas a parasitic element with only one coupling (e.g., omitting a second coupling that fixes the parasitic element to a ground plane) may tune a frequency response lower when shorted to ground, including the second coupling fixed to ground can pinch the upper and lower frequencies together. This can provide improved antenna connectivity in some implementations.

It should be understood that other configurations are possible within the scope of this disclosure. For example, more or fewer parasitic elements can be employed. The positioning and/or other tuning of the parasitic element(s) can be altered to achieve additional modes that can exhibit different frequencies and/or combinations of frequencies.

Figure 6:
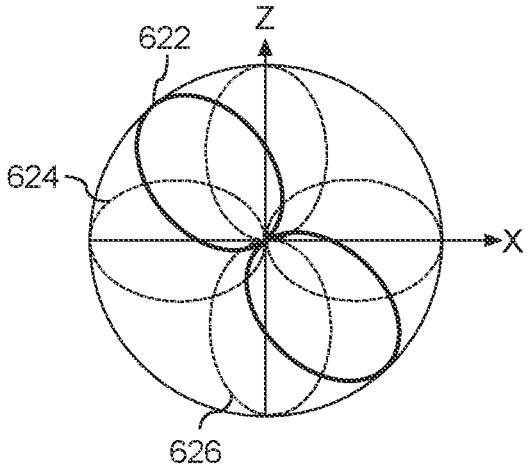
FIG. 6 illustrates an example two-dimensional antenna radiation pattern associated with an example antenna system according to example embodiments of the present disclosure.

FIG. 6 illustrates a two-dimensional antenna radiation pattern associated with the antenna system of any of FIGS. 1A-4. The radiation pattern can be shifted by controlling an electrical characteristic associated with closed-loop parasitic element(s) of a modal antenna according to example aspects of the present disclosure. For example, in some embodiments, the radiation pattern can be shifted from a first mode 622 to a second mode 624, or a third mode 626. For example, a first mode 622 can be associated with an open-circuited closed-loop parasitic element (e.g., wherein a tuning element including a switch is in opened) and a third mode 626 can be associated with a shorted closed-loop parasitic element (e.g., wherein a tuning element including a switch is closed to couple the parasitic element to a ground plane).

As used herein, "about" in conjunction with a stated numerical value is intended to refer to within 10% of the stated numerical value.

As used herein, "proximate" in reference to one or more objects is intended to refer to a positioning of the one or more objects such that the one or more objects achieve any one or more of a functional relationship, with and/or without a physical coupling (e.g., a parasitic element disposed proximate to a radiating element, such as within an antenna volume and forming an electromagnetic coupling), having no interjecting components disposed therebetween, and/or being disposed on a same substrate. As one example, proximate objects may have a distance of less than about 10 cm between a surface of each object, such as less than about 1 cm, such as less than about 10 mm.

While the present subject matter has been described in detail with respect to specific example embodiments thereof, it will be appreciated that those skilled in the art, upon attaining an understanding of the foregoing can readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be readily apparent to one of ordinary skill in the art.

What is claimed is:

1. An antenna system comprising:

a ground plane;

a driven element spaced apart from the ground plane; and a parasitic element disposed proximate to the driven element, the parasitic element coupled to the ground plane by a first coupling and a second coupling, the second coupling being independent from the first coupling;

wherein the parasitic element comprises a substantially horizontal portion, a first substantially vertical portion comprising the first coupling, and a second substantially vertical portion comprising the second coupling;

wherein the driven element defines a longest driven element dimension, the substantially horizontal portion of the parasitic element defines a longest horizontal portion dimension, and wherein the longest driven element dimension and longest horizontal portion dimension are substantially parallel;

wherein the substantially horizontal portion of the parasitic element is vertically offset from the driven element.

2. The antenna system of claim 1, wherein the substantially horizontal portion is planar, and wherein the substantially horizontal portion is parallel to the ground plane.

3. The antenna system of claim 1, wherein the first coupling comprises at least one tunable component.

4. The antenna system of claim 3, wherein the at least one tunable component of the first coupling comprises at least one of a switch, tunable capacitor, MEMS device, tunable inductor, a tunable phase shifter, a field-effect transistor, or a diode.

5. The antenna system of claim 3, further comprising a tuning circuit configured to control the at least one tunable component to adjust an electrical characteristic of the parasitic element.

6. The antenna system of claim 3, wherein the at least one tunable component is disposed on a common substrate with at least one active component coupled to the driven element.

7. The antenna system of claim 6, wherein the active component is configured to impedance match the driven element.

8. The antenna system of claim 1, wherein the first coupling is configured to selectively ground the parasitic element and the second coupling fixes the parasitic element to the ground plane.

9. The antenna system of claim 1, wherein the driven element comprises a planar driven element.

10. The antenna system of claim 9, wherein the planar driven element is parallel to the ground plane.

11. The antenna system of claim 1, wherein the driven element comprises a spiral planar driven element, the spiral planar driven element comprising a continuous airgap between a periphery of the driven element and a center airgap portion, the center airgap portion surrounded by the driven element on at least three sides.

12. The antenna system of claim 1, wherein the driven element is coupled to at least one active component by a first driven element coupling.

13. The antenna system of claim 12, wherein the at least one active component comprises an impedance matching circuit.

14. The antenna system of claim 12, wherein the driven element is coupled to the ground plane by a second driven element coupling that is independent from the first driven element coupling.

15. An antenna system comprising:

a ground plane;

a planar driven element spaced apart from the ground plane and coupled to a first one or more tunable components; and a parasitic element comprising a substantially horizontal portion, a first substantially vertical portion, and a second substantially vertical portion, the parasitic element disposed proximate to the planar driven element;

wherein the first substantially vertical portion is coupled to the ground plane by a first coupling comprising a first coupling tunable component; and wherein the second substantially vertical portion is coupled to the ground plane by a second coupling that is independent from the first coupling, wherein the parasitic element is within a volume defined by the planar driven element.

16. The antenna system of claim 15, wherein at least one of the first one or more tunable components or the first coupling tunable component comprise at least one of a switch, capacitor, inductor, or varactor.

17. The antenna system of claim 15, wherein the first one or more tunable components and the first coupling tunable component are disposed on a common substrate.

* * * * *